US010883265B2

(12) United States Patent
Kelly et al.

(10) Patent No.: US 10,883,265 B2
(45) Date of Patent: Jan. 5, 2021

(54) CONNECTOR FOR PRECAST CONCRETE STRUCTURES

(71) Applicant: Meadow Burke, LLC, Riverview, FL (US)

(72) Inventors: David Kelly, Sacramento, CA (US); Michael J. Recker, Palmetto, FL (US); Gary Hartman, Riverview, FL (US); Ronald G. Naumann, Valrico, FL (US)

(73) Assignee: Meadow Burke, LLC, Riverview, FL (US)

( * ) Notice: Subject to any disclaimer, the term of this patent is extended or adjusted under 35 U.S.C. 154(b) by 0 days.

(21) Appl. No.: 15/994,084

(22) Filed: May 31, 2018

(65) Prior Publication Data

US 2018/0347179 A1 Dec. 6, 2018

Related U.S. Application Data

(60) Provisional application No. 62/512,835, filed on May 31, 2017.

(51) Int. Cl.
*E04B 1/41* (2006.01)
*E04B 1/21* (2006.01)
(Continued)

(52) U.S. Cl.
CPC ..... *E04B 1/41* (2013.01); *E04B 1/043* (2013.01); *E04B 1/215* (2013.01); *E04B 1/4114* (2013.01);
(Continued)

(58) Field of Classification Search
CPC ..... A47B 96/061; A47B 57/045; A47B 57/16; A47B 57/425; E04B 1/4114; E04B 1/043;
(Continued)

(56) References Cited

U.S. PATENT DOCUMENTS 693,127 A 2/1902 Gardner et al.
1,189,988 A 7/1916 Moody
(Continued)

FOREIGN PATENT DOCUMENTS

CA 2776394 A1 * 7/2012 ..... A47B 57/425
CH 305283 A * 2/1955 ..... A47B 57/045
(Continued)

OTHER PUBLICATIONS

Nafadi et al. "Ledge behavior and strength of long-span L-shaped beams," PCI Journal, Mar.-Apr. 2018, p. 50-66.
(Continued)

*Primary Examiner* — Brian D Mattei
*Assistant Examiner* — Charissa Ahmad
(74) *Attorney, Agent, or Firm* — Sheridan Ross P.C.

(57) ABSTRACT

An apparatus, system, and method is provided to connect precast concrete panels to a structural member. The connector can have a receiving member embedded in a precast concrete panel and can further have an attachment member that selectively interconnects to the receiving member. This attachment member can have a surface that is oriented substantially perpendicular to the precast concrete panel and that receives or supports a structural member such as a floor joist or a second precast concrete panel. The configuration of a protrusion of the attachment member allows for a rapid and secure interconnection with an aperture in the receiving member. A builder can use the connector system described herein to rapidly and securely assemble multiple precast concrete panels to structural members in the construction of, for example, a parking garage or other similar structure.

13 Claims, 8 Drawing Sheets

(51) Int. Cl.
*E04B 1/04* (2006.01)
*E04B 1/38* (2006.01)
*E04B 5/06* (2006.01)

(52) U.S. Cl.
CPC ..... *E04B 5/06* (2013.01); *E04B 2001/405* (2013.01); *E04B 2103/02* (2013.01); *E04B 2103/06* (2013.01)

(58) Field of Classification Search
CPC ..... E04B 2001/2409; E04B 2001/2421; E04B 2001/405; E04B 1/41; E04B 2001/2412
See application file for complete search history.

(56) References Cited

U.S. PATENT DOCUMENTS 1,201,540 A * 10/1916 Banes ..... E04B 1/4107 52/708
2,053,873 A 9/1936 Niederhofer
2,218,894 A * 10/1940 Schlosser ..... F16L 3/22 248/73
2,336,604 A * 12/1943 Edward ..... A47B 57/425 248/243
2,477,735 A * 8/1949 Gentile ..... A47B 57/425 248/220.31
2,660,050 A * 11/1953 Hosbein ..... F27D 1/004 52/479
3,085,693 A * 4/1963 Shell ..... A47B 57/425 211/134
3,273,847 A * 9/1966 Berman ..... A47B 57/425 248/243
3,537,671 A * 11/1970 Wenthe ..... A47B 96/061 248/247
3,628,762 A * 12/1971 Williams ..... F16B 21/088 248/235
3,637,086 A * 1/1972 Klein ..... A47B 57/482 211/192
3,652,048 A 3/1972 Hartman
3,954,243 A * 5/1976 Sharp ..... A47B 96/068 248/235
D254,290 S * 2/1980 Smith ..... A47B 96/061 D8/381
4,198,913 A * 4/1980 Haworth ..... A47B 96/061 108/108
4,378,925 A * 4/1983 Griffin ..... A47B 57/045 108/108
4,528,915 A * 7/1985 Cofer ..... A47B 96/061 108/108
4,588,866 A 5/1986 Monti
D295,950 S * 5/1988 Johnston ..... A47B 87/005 108/108
4,951,438 A * 8/1990 Thoresen ..... E04B 1/215 403/187
5,154,388 A * 10/1992 Magaro ..... A47B 96/061 108/108
5,548,939 A * 8/1996 Carmical ..... E04B 1/4135 52/698
5,711,122 A * 1/1998 Lee ..... E04G 17/16 52/283
5,881,519 A 3/1999 Newkirk
6,019,331 A * 2/2000 Hoogland ..... A47B 96/061 108/108
6,494,639 B1 12/2002 Friend
6,672,226 B2 * 1/2004 Bohnacker ..... A47B 96/061 108/108
8,209,924 B2 * 7/2012 Foley ..... E04B 1/2403 403/403
8,209,925 B2 * 7/2012 Foley ..... E04B 1/2403 403/403
8,365,484 B2 * 2/2013 Foley ..... E04B 1/4114 403/403
9,277,814 B2 * 3/2016 Winker ..... A47B 87/005
10,233,630 B1 * 3/2019 Francies, III ..... E04B 1/043
10,370,845 B2 * 8/2019 Francies, III ..... E04B 1/043

FOREIGN PATENT DOCUMENTS

CH 684240 A5 * 8/1994 ..... A47B 57/10
DE 120510 C * 12/1899
DE 1222634 B * 8/1966 ..... A47B 57/045
GB 173031 A * 12/1921 ..... A47B 57/425

OTHER PUBLICATIONS

U.S. Appl. No. 16/735,576, filed Jan. 6, 2020, Kelly et al.
U.S. Appl. No. 29/720,068, filed Jan. 9, 2020, Kelly et al.
Official Action for Canadian Patent Application No. 3006818, dated Jun. 18, 2019, 3 pages.

* cited by examiner

CONNECTOR FOR PRECAST CONCRETE STRUCTURES

CROSS-REFERENCE TO RELATED APPLICATIONS

This application claims priority under 35 U.S.C. § 119(e) to U.S. Provisional Patent Application Ser. No. 62/512,835 filed May 31, 2017, which is incorporated herein in its entirety by reference.

FIELD OF THE INVENTION

The present invention is directed to the assembly of precast concrete panels, and more specifically to connectors used to orient, position, and secure precast concrete panels and floor joists relative to each other.

BACKGROUND OF THE INVENTION

Precast concrete panels and associated connectors are widely used in the construction industry. Traditional concrete structures are formed in place and on site, whereas precast concrete panels are poured and cured off site in a modern manufacturing facility before being transported to the building site. Precast concrete panels allow for better quality control and reduced costs since precast forms can be reused hundreds or thousands of times. The popularity of precast concrete panels has created a demand for efficient, cost-effective connectors and methods for joining multiple precast concrete panels and floor joists, beams, and other associated structural components.

Connectors can be used to secure precast concrete panels and floor joists together in a variety of predetermined position and orientation. These connectors are incorporated into the precast concrete panel during construction of the panel, or alternatively, the connectors can be incorporated into the precast concrete panel after construction of the panel, for example, by bolting the connector to the panel. Generally, these connectors have a two-part design where a first part interconnects to a second part to secure two objects together, for example, a wall panel and a floor panel. Examples of prior art devices may be found in U.S. Pat. Nos. 2,053,873 and 6,494,639, which are incorporated herein in their entireties by reference. These references describe connectors that use keyhole and lug combinations which require a shearing motion for assembly that can be difficult to assemble. These references also describe connectors that use keyhole and hook combinations which can be similarly difficult to assemble. Thus, unnecessary time and costs associated with assembling the precast panels and/or floor joists may occur, as well as inherent safety issues associated with positioning a large concrete structure. Further, there is a need for a connector system that quickly joins precast walls panels and floor joists to improve the overall time efficiency of assembly of a precast concrete structure, and thus save costs.

SUMMARY OF THE INVENTION

The above shortcomings and other needs are addressed by the various embodiments and configurations of the present invention. It is an objective of the present invention to provide a connector system that rapidly and securely interconnects an attachment member to a receiving member, which is embedded in a precast concrete panel such as a wall panel. The attachment member rotates into the receiving member and provides a surface to accept a second structural member such as a precast concrete panel, a floor panel, a floor joist, a beam, etc.

One aspect of embodiments of the present invention is to provide an attachment member that has a retention surface and a bearing surface to transmit the forces generated by a second structural member such as a precast concrete panel, floor joist, or I-beam resting on the attachment member to the receiving member. In some embodiments, the attachment member cantilevers from the receiving member, and a second precast concrete panel, floor joist, or I-beam rests on the attachment member. This configuration imposes a variety of forces on the selective interconnection between the attachment member and the receiving member. First, a retention surface of the attachment member extends through the receiving member and contacts a back surface of the receiving member. Thus, as the second structural member imparts a rotational force on the attachment member, the retention surface drives into the back surface of the receiving member to bear the rotational force. Similarly, a bearing surface on the attachment member rests in an aperture of the receiving member. Therefore, as the second structural member rests on the attachment member and generates a downward force, the bearing surface imparts the downward force to the receiving member.

A further aspect of the present invention is to provide a connector system with an attachment member that has an arcuate surface which facilitates rotation of the attachment member into the receiving member. The retention surface of a protrusion of the attachment member must extend above the aperture in the receiving member, and to do so, the distance between a distal end of the retention surface and the bearing surface of the attachment member is larger than the longitudinal distance of the aperture in the receiving member. Stated another way, the distance between a top surface that is adjacent the retention surface and the bearing surface is larger than the longitudinal distance of the aperture. Thus, in a first position, the attachment member and associated surfaces are oriented at an acute angle relative to the receiving member so that the retention surface of the protrusion can pass through the aperture of the receiving member. As the attachment member is inserted into the aperture of the receiving member, an arcuate surface of the attachment member contacts an arcuate surface defined by a void former. The arcuate void in the precast concrete wall panel allows the attachment member to rotate into a second position such that the acute angle is reduced to substantially zero degrees, the retention surface of the attachment member is positioned against a back surface of the receiving member, and the bearing surface of the attachment member is seated on an inner surface of the aperture of the receiving member. It will be appreciated that other embodiments can have non-arcuate transition surfaces between a top surface and a bearing surface.

Another aspect of embodiments of the present invention is to provide a connector system with an additional bearing surface. The retention, arcuate, and bearing surfaces described above may be disposed on a first protrusion of the attachment member, and the additional bearing surface may be disposed on a second protrusion. In the first position, the additional bearing surface of the attachment member is outside of a corresponding aperture in the receiving member, and in the second position, the additional bearing surface is seated on an inner surface of a corresponding aperture in the receiving member. Like the bearing surface of the first protrusion, this bearing surface can support downward forces and also act to resist rotational forces imparted by a second precast concrete panel, floor joist, or I-beam resting on the attachment member. It will be appreciated that various embodiments may optionally comprise the additional bearing surface and/or second protrusion.

Yet another aspect of embodiments of the present invention is to provide a connector system with a variety of combinations of members, apertures, protrusions, and surfaces. Some embodiments of the attachment member have two first protrusions and two second protrusions, and the receiving member has corresponding apertures. However, it will be appreciated that, for example, the attachment member only has a single first protrusion and a single second protrusion, or only a first protrusion, etc.

A further aspect of embodiments of the present invention is to provide an attachment member with a horizontal member located at a lower position on the attachment member. With the lower position, the horizontal member can position a second structural member that rests on the horizontal member lower with respect to the precast concrete panel that has the receiving member. This allows a second structural member to be positioned lower on sprandrel beams and closer to the top of openings in a parking garage application to increase head heights. This also minimizes the portion of the connector system that is exposed to reduce the likelihood of tampering, damage from an impact, etc. In addition, side plates can extend up from the horizontal member to provide lateral stability to a second structural member that is positioned on the horizontal member. This increase in stability improves the overall safety of the structure in which the connector system is used and can improve the survival of the structure in, for example, an earthquake.

One particular embodiment of the present invention is a structural connector for a precast concrete panel, comprising a receiving member having a body with at least one anchor extending from a back surface of the body, the receiving member having a first aperture and a second aperture, and wherein the first aperture has a longitudinal dimension; an attachment member having a first protrusion and a second protrusion, wherein the first protrusion has a retention surface, a top surface adjacent to the retention surface, and a bearing surface oriented substantially perpendicular to the retention surface, wherein a distance between the top surface and the bearing surface is larger than the longitudinal dimension of the first aperture; wherein, in a first position, the attachment member is configured to be oriented with respect to the receiving member such that the first aperture receives the first protrusion; and wherein, in a second position, the attachment member is configured to be oriented with respect to the receiving member such that the retention surface contacts the back surface of the body and the second recess receives the second protrusion.

In some embodiments, the attachment member comprises an arcuate transition surface between the top surface and the bearing surface, wherein the arcuate transition surface is configured to rotate to reorient the attachment member from the first position to the second position. In various embodiments, the structural connector further comprises a void former extending from the first aperture and from the back surface of the body to form a partially enclosed volume adjacent to the first aperture in a precast concrete panel. In some embodiments, in the first position, the bearing surface of the first protrusion is positioned outside of the first aperture. In various embodiments, in the second position, the bearing surface of the first protrusion is configured to contact an inner surface of the first aperture.

In some embodiments, the structural connector further comprises a horizontal member of the attachment member that is oriented substantially parallel with the bearing surface, wherein the horizontal member is configured to receive a second structural member. In various embodiments, the longitudinal dimension of the first aperture is oriented between an upper end and a lower end of the receiving member. In some embodiments, the structural connector further comprises a bearing surface of the second protrusion that is substantially parallel with the bearing surface of the first protrusion, wherein, in the first position, the bearing surface of the second protrusion is positioned outside of the second aperture, and wherein, in the second position, the bearing surface of the second protrusion contacts an inner surface of the second aperture. In various embodiments, the second protrusion is aligned with the first protrusion in a horizontal direction of the attachment member.

Another particular embodiment of the present invention is a precast concrete panel with integral connector mechanism, comprising a precast concrete panel with an outer surface, an inner surface, and sidewalls extending around a perimeter edge; a receiving member having a body extending in a first plane that is configured to be substantially parallel with at least one of the outer surface and the inner surface of the precast concrete panel, the receiving member having at least one aperture, wherein each aperture has a longitudinal dimension; at least one anchor extending into the precast concrete panel from an interior surface of the body; and a void former positioned adjacent to each of the apertures, each void former defines a partially enclosed volume adapted to receive a protrusion.

In various embodiments, the precast concrete panel further comprises an attachment member having at least one protrusion and having a horizontal member extending in a second plane; a retention surface of each protrusion, the retention surface oriented substantially perpendicular to the second plane, wherein a top surface is positioned adjacent the retention surface; a bearing surface of each protrusion, the bearing surface oriented substantially parallel to the second plane, wherein a distance between the top surface and the bearing surface is larger than the longitudinal dimension of each aperture; and wherein in an assembled state, each protrusion from the at least one protrusion extends through an aperture from the at least one aperture, the retention surface contacts the interior surface of the body, the bearing surface contacts an inner surface of the aperture, and the first and second planes are oriented substantially perpendicular to each other.

In some embodiments, the precast concrete panel further comprises an arcuate transition surface between the top surface and the bearing surface, wherein the partially enclosed volume has an arcuate surface configured to receive the arcuate transition surface and allow the at least one protrusion of the attachment member to rotate into the at least one aperture of the receiving member. In various embodiments, the precast concrete panel further comprises a second protrusion of the attachment member and a second aperture of the receiving member, wherein a bearing surface of the second protrusion is configured to contact an inner surface of the second aperture in the assembled state. In some embodiments, the precast concrete panel further comprises at least one side plate that extends from the horizontal member, wherein the at least one side plate is substantially perpendicular to the horizontal member, and the horizontal member defines a bottom surface of the attachment member. In various embodiments, the at least one aperture is two apertures, and the longitudinal dimension of each aperture is oriented in a vertical direction of the receiving member.

Yet another particular embodiment of the present invention is a method of manufacturing a precast concrete panel with an integral connector, comprising (i) providing a form that defines a precast concrete panel; (ii) positioning a receiving member in the form, wherein the receiving member has a planar body configured to be positioned substantially parallel to a face of the precast concrete panel, the planar body having at least one aperture, and the receiving member having at least one anchor member extending into the form; (iii) positioning a void former on a back surface of the receiving member and adjacent to an aperture of the at least one aperture to define a partially enclosed volume; and (iv) pouring concrete into the form to produce the precast concrete panel.

In some embodiments, the method further comprises (v) providing an attachment member having a protrusion with a retention surface, a top surface adjacent to the retention surface, and a bearing surface, wherein a distance between the top surface and the bearing surface is larger than the longitudinal dimension of the aperture; and (vi) rotating the attachment member into the receiving member and the protrusion into the partially enclosed volume such that the retention surface contacts the back surface of the body, and the bearing surface contacts an inner surface of the aperture. In various embodiments, the method further comprises (vii) placing a reinforcing structure into the form; and (viii) connecting the at least one anchor of the receiving member to the reinforcing structure. In some embodiments, the attachment member has a horizontal member configured to receive a second structural member. In various embodiments, the longitudinal dimension of the aperture is oriented along a vertical direction of the precast concrete panel.

Another particular embodiment of the present invention is a method for selectively interconnecting an attachment member to a receiving member to assemble precast concrete panels, comprising (ix) embedding a receiving member in a first precast concrete panel, the receiving member having a back surface, a plurality of first apertures, and a plurality of second apertures, wherein a void former extends from each first aperture into the precast concrete panel to form a partially enclosed volume with an arcuate surface; (x) providing an attachment member with a plurality of first protrusions and a plurality of second protrusions, wherein each first protrusion has a bearing surface, a retention surface, and has an arcuate surface; (xi) orienting the attachment member into a first position such that a horizontal member of the attachment member forms an acute angle with the receiving member; (xii) engaging the arcuate surface of the attachment member with the arcuate surface of the partially enclosed volume; (xiii) rotating the attachment member into a second position relative to the receiving member and about a center of curvature of the arcuate surfaces such that the retention surface of the attachment member contacts the back surface of the receiving member, the bearing surface of each first protrusion contacts each first aperture, and each second protrusion extends into each second aperture; (xiv) placing at least one of a second precast concrete panel, a floor joist, and an I-beam on the horizontal surface of the attachment member.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
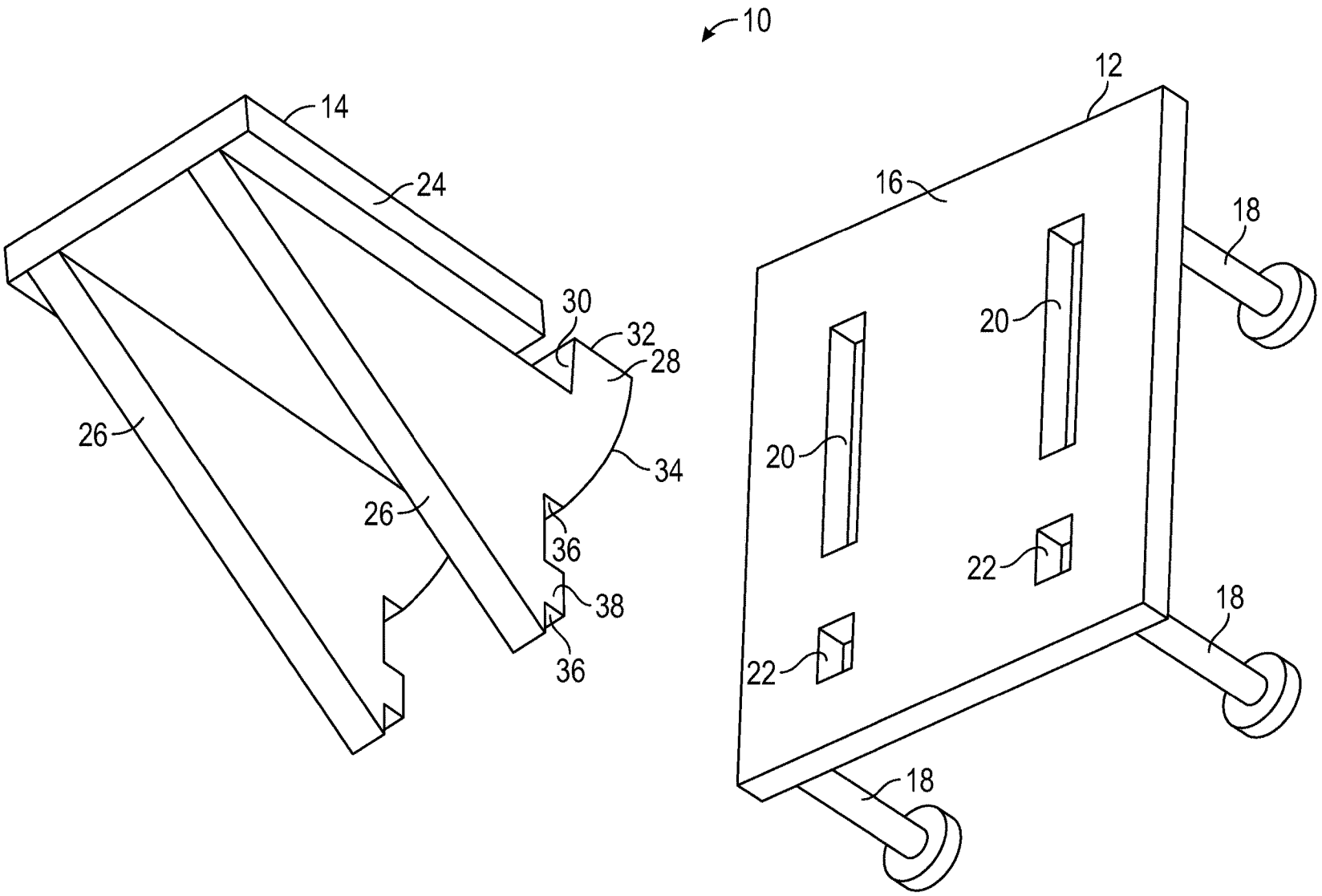
FIG. 1 is a front perspective view of a connector system with an attachment member and a receiving member in accordance with one embodiment of the present invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Connector System |
| 12 | Receiving Member |
| 14 | Attachment Member |
| 16 | Body |
| 18 | Anchor |
| 20 | First Aperture |
| 22 | Second Aperture |
| 24 | Horizontal Member |
| 26 | Vertical Member |
| 28 | First Protrusion |
| 30 | Retention Surface |
| 32 | Top Surface |
| 34 | Arcuate Surface |
| 36 | Bearing Surface |
| 38 | Second Protrusion |
| 40 | Precast Concrete Panel |
| 42 | Volume |
| 44 | Arcuate Surface |
| 46 | Second Structural Member |
| 48 | Transition Surface |
| 50 | Side Plate |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict connectors, members, protrusions, apertures, and methods and systems for using the same, the present invention is not limited to these embodiments.

Now referring to FIG. 1, a perspective view of the connector system 10 is provided. Generally, the system 10 comprises an attachment member 14 that selectively interconnects to the receiving member 12. The receiving member 12 can be embedded in a precast concrete panel such that a body 16 of the receiving member 12 is substantially parallel to a side wall or surface of the precast concrete panel. At least one anchor 18 extends from the body 16 of the receiving member 12 and into the precast concrete panel to secure and embed the receiving member 12 in the precast panel. The at least one anchor 18 can extend into the panel in a first direction that is substantially perpendicular to the body 16. FIG. 1 depicts an anchor 18 extending from each corner of a rectangular-shaped body 16, however, it will be appreciated that the present invention may include any number of anchors 18 extending in other directions from the body 16.

The receiving member 12 also has a series of apertures 20, 22 to aid in the selective interconnection with the attachment member 14. Specifically in FIG. 1, the receiving member 12 has two first apertures 20 and two second apertures 22. The first apertures 20 are elongated and each aperture has a longitudinal dimension that is oriented in a vertical direction. The second apertures 22 are substantially square or rectangular in shape and positioned below the first apertures 20. As discussed in greater detail below with respect to FIGS. 2-3, the first apertures 20 can have adjacent cavities that are formed using a void former that extends into the precast concrete panel to establish a partially enclosed volume. In the depicted embodiment, the first and second apertures 20, 22 are aligned with each other in the horizontal dimension of the body 16. However, it will be appreciated the apertures 20, 22 may be offset, and/or there may be greater or fewer than two first apertures 20 and two second apertures 22.

The attachment member 14 has several features that allow the attachment member 14 to rapidly and securely interconnect to the receiving member 12 and bear a second precast concrete panel, floor joist, or I-beam. The attachment member 14 in FIG. 1 has a horizontal member 24 on which a second precast concrete panel can rest, and two vertical members 26 extend downward from the horizontal member 24 in a substantially parallel manner. The vertical members 26 taper from a proximal end to a distal end of the attachment member 14. The proximal end of the attachment member 14 also has first protrusions 28 and second protrusions 38. The first protrusions 28 extend into the first apertures 20 of the receiving member 12 and the second protrusions 38 extend into the second apertures 22 to selectively interconnect the attachment member 14 to the receiving member 12. It will be appreciated that, like the variety of apertures, the protrusions may have a corresponding variety in position, numbers, shape, etc.

The first protrusion 28 has a series of surfaces to aid in the selective interconnection with the corresponding first aperture 20. A retention surface 30 extends downward from a top surface 32 of the protrusion 28. An arcuate surface 34 also extends downward from the top surface 32, and the arcuate surface 34 terminates at a bearing surface 36, which in this embodiment is substantially perpendicular to the retention surface 30. The retention surface 30 and the bearing surface 36 bear the forces generated by a second precast concrete panel, or other object, resting on the attachment member 14. The arcuate surface 34 provides a guiding and rotation function as the attachment member 14 selectively interconnects to the receiving member 12. How these surfaces 30, 32, 34, 36 work together to achieve these functions is described in greater detail below with respect to FIGS. 2 and 3.

The attachment member 14 optionally comprises second protrusions 38 that extend into the second aperture 22 of the receiving member 12 as the attachment member 14 is rotated into the receiving member 12. The second protrusions 38 also have a bearing surface 36 that can bear at least some of the forces generated by a second precast concrete panel or other object resting on the attachment member 14. Although the second protrusions 38 are shown as having a square shape, it will be appreciated that the second protrusions 38 may be cylindrically or rod shaped, or may not exist in some embodiments of the present invention.

Figure 2:
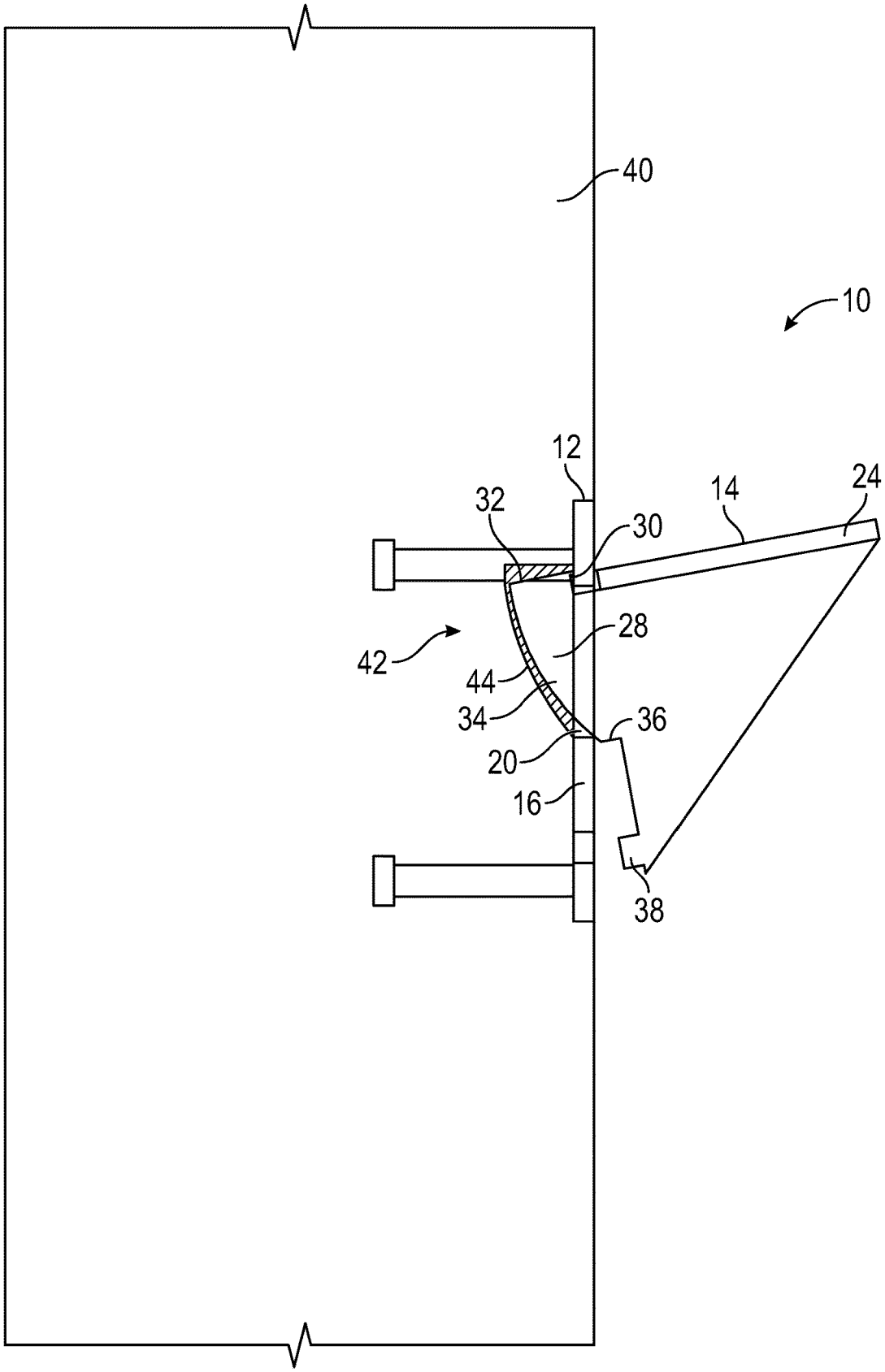
FIG. 2 is a partial cross-sectional, side elevation view of a connector system with an attachment member in a first position in accordance with the embodiment of FIG. 1.
Figure 3:
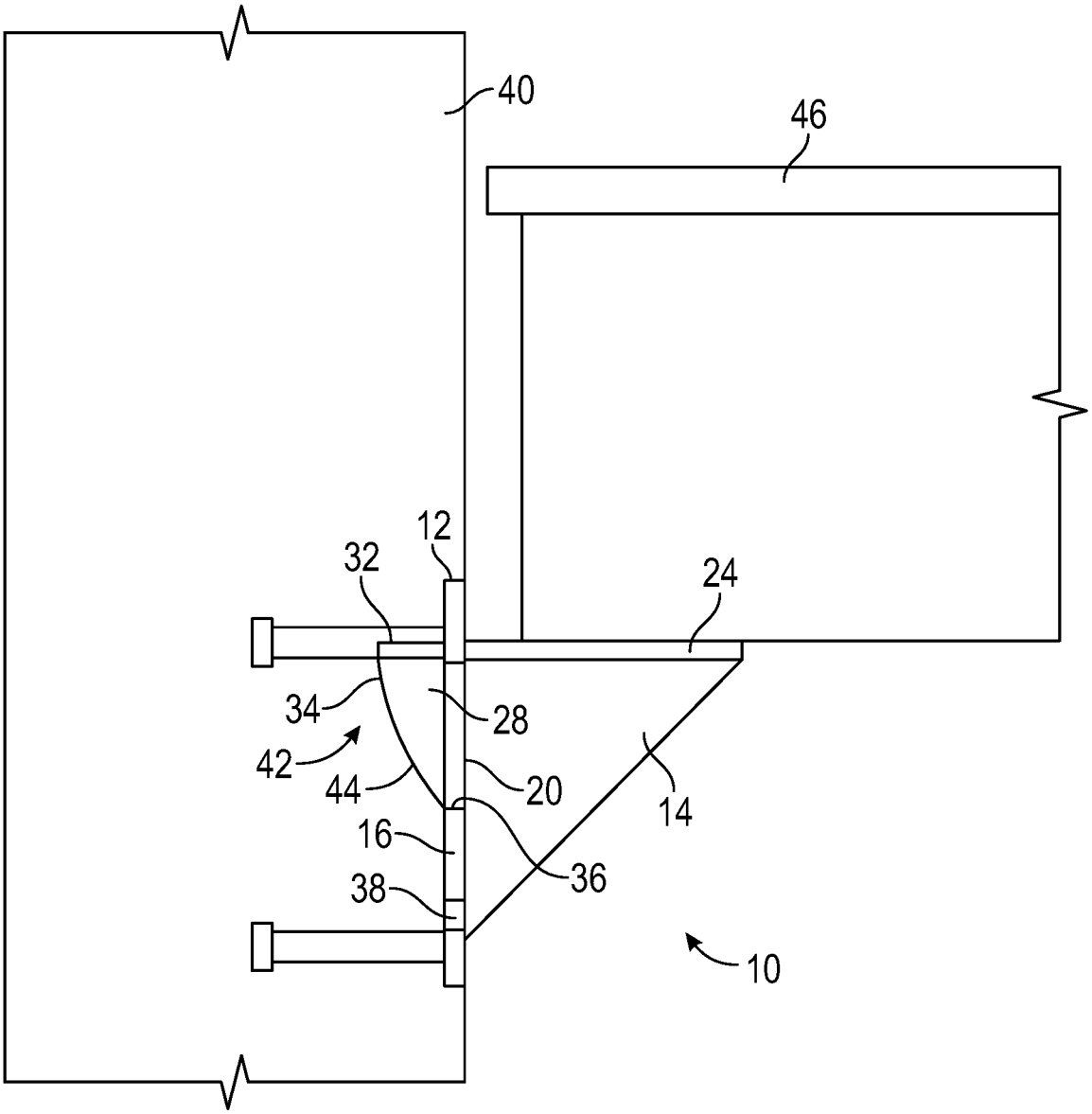
FIG. 3 is a partial cross-sectional, side elevation view of a connector system with an attachment member in a second position and a floor joist on a horizontal member of the attachment member in accordance with the embodiment of FIG. 1.

Now referring to FIGS. 2 and 3, partial cross-sectional views of the connector system 10 are provided. The attachment member 14 is in a first position in FIG. 2 and engages the receiving member 12 at an acute angle. Then, the attachment member 14 is in a second position in FIG. 3 where the attachment member 14 has rotated into a selective interconnection with the receiving member 12. The first protrusion 28 extends into a volume 42 defined by a void former, and together the volume 42 and the adjacent first aperture define a partially enclosed volume. In addition, the volume 42 can also refer to the partially enclosed volume.

For the retention surface 30 of the attachment member 14 to bear a force, at least a portion of the retention surface 30 extends above the first aperture 20 and contacts a back surface of the body 16 as shown in FIG. 3. As a result, the distance between the top surface 32 of the first protrusion 28, alternatively the distal end or edge of the retention surface 30, and the bearing surface 36 is larger than the longitudinal distance of the first aperture 20. Therefore, the first protrusion 28 of the attachment member 14 cannot translate laterally into the first aperture 20 of the receiving member 12, but instead may rotate into place.

The arcuate surface 34 facilitates the selective interconnection between members 12, 14 by allowing the first protrusion 28 to enter the first aperture at an acute angle in a first position, and then rotate to a second position. The acute angle is formed between the planar body 16 of the receiving member 12 and the direction that the protrusions 28, 38 extend from the attachment member 14. Alternatively, the acute angle is formed between the planar body 16 of the receiving member 12 and a planar surface of the horizontal member 24 of the attachment member 14. In some embodiments, the acute angle ranges between approximate 5 and 45 degrees. In various embodiments, the acute angle is approximately 20 degrees. These acute angles reduce to substantially zero degrees as the planar body 16 of the receiving member 12 and either the direction of the protrusions 28, 38 or the planar surface of the horizontal member 24 establish a substantially perpendicular orientation relative to each other in the second position.

The acute angle allows the larger distance between the top surface 32 and the bearing surface 36 of the first protrusion 28 to pass into the first aperture 20 and adjacent volume 42. As the first protrusion 28 moves into the first aperture 20 and volume 42, the arcuate surface 34 of the first protrusion 28 contacts an arcuate surface 44 of the volume 42. The contact between arcuate surfaces 34, 44 allows the attachment member 14 to rotate relative to the receiving member 12. The arcuate surface 34 is depicted as having a constant radius of curvature with the attachment member 14 rotating about a center of curvature of the arcuate surfaces, but it will be appreciated that other embodiments may have an arcuate surface 34 that has a variable curvature, a surface defined by n-order polynomials, a surface defined by disjointed shapes, a surface that facilitates both rotation and translational movement such that the attachment member 14 does not rotate about a single point, etc.

Once the attachment member 14 rotates into a second position relative to the receiving member 12, the bearing surface 36 of the first protrusion 28 rests on an inner surface of the first aperture 20, and the first protrusion at least partially extends into the volume 42 defined by the void former adjacent the first aperture 20. Also, once the attachment member 14 rotates into place, the retention surface 30 extends above the first aperture 20 and contacts the back surface of the body 16 to transmit at least some of the force generated by a floor joist 46 or other object that rests on the horizontal member 24 of the attachment member 14 to the precast concrete panel 40.

It will be further appreciated that the components discussed herein may comprise a depression and detent combination to promote the selective interconnection between the attachment member and the receiving member. For example, after the attachment member is in a second position, a shaking or jostling could shake the attachment member out of the second position. A detent positioned on the side of the protrusion and a depression positioned on the inner surface of the aperture or associated volume could allow a more secure selective, or even permanent, interconnection between the attachment member and the receiving member.

Figure 4:
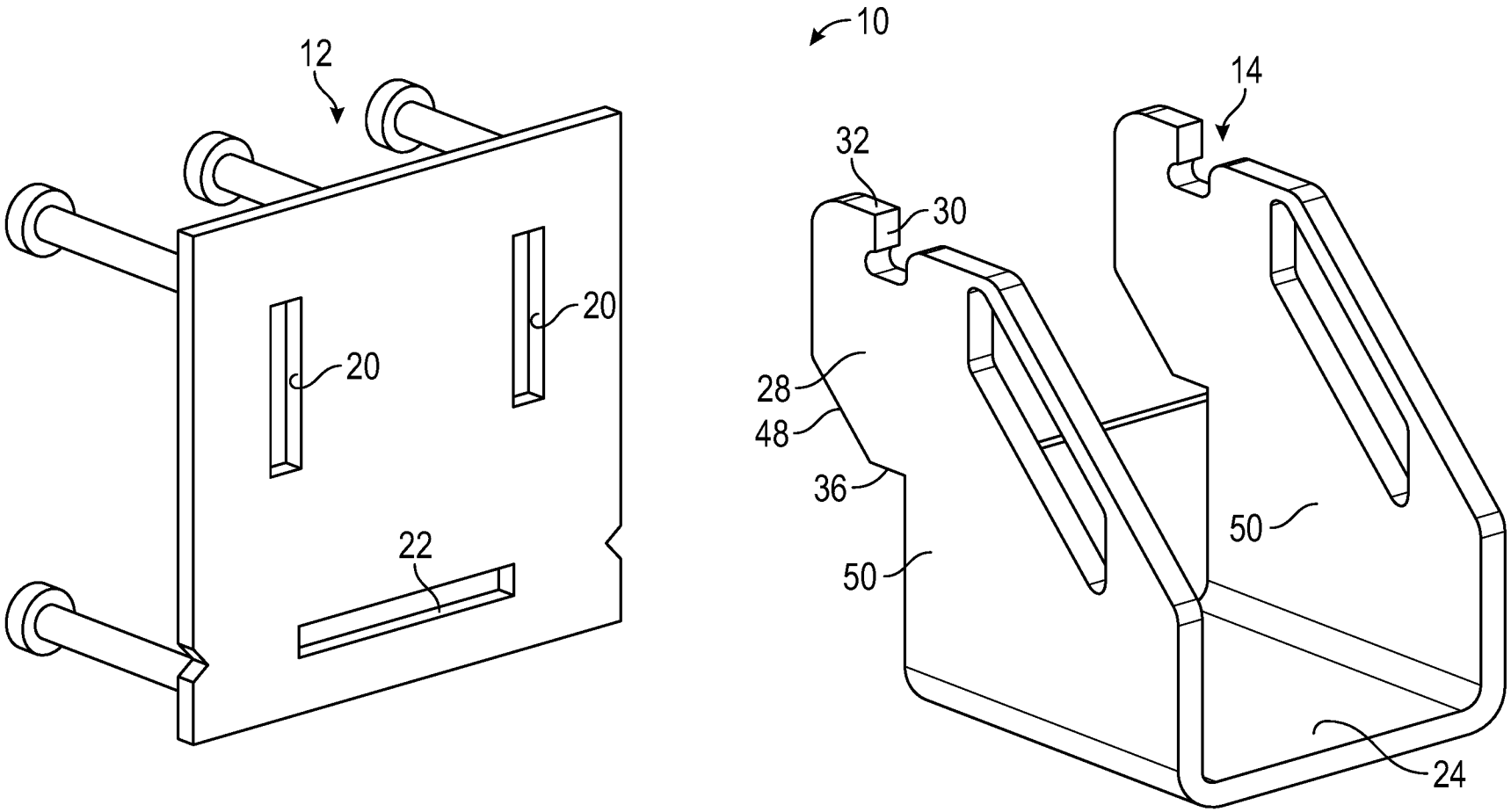
FIG. 4 is a front perspective view of another connector system with an attachment member and a receiving member in accordance with one embodiment of the present invention.
Figure 5:
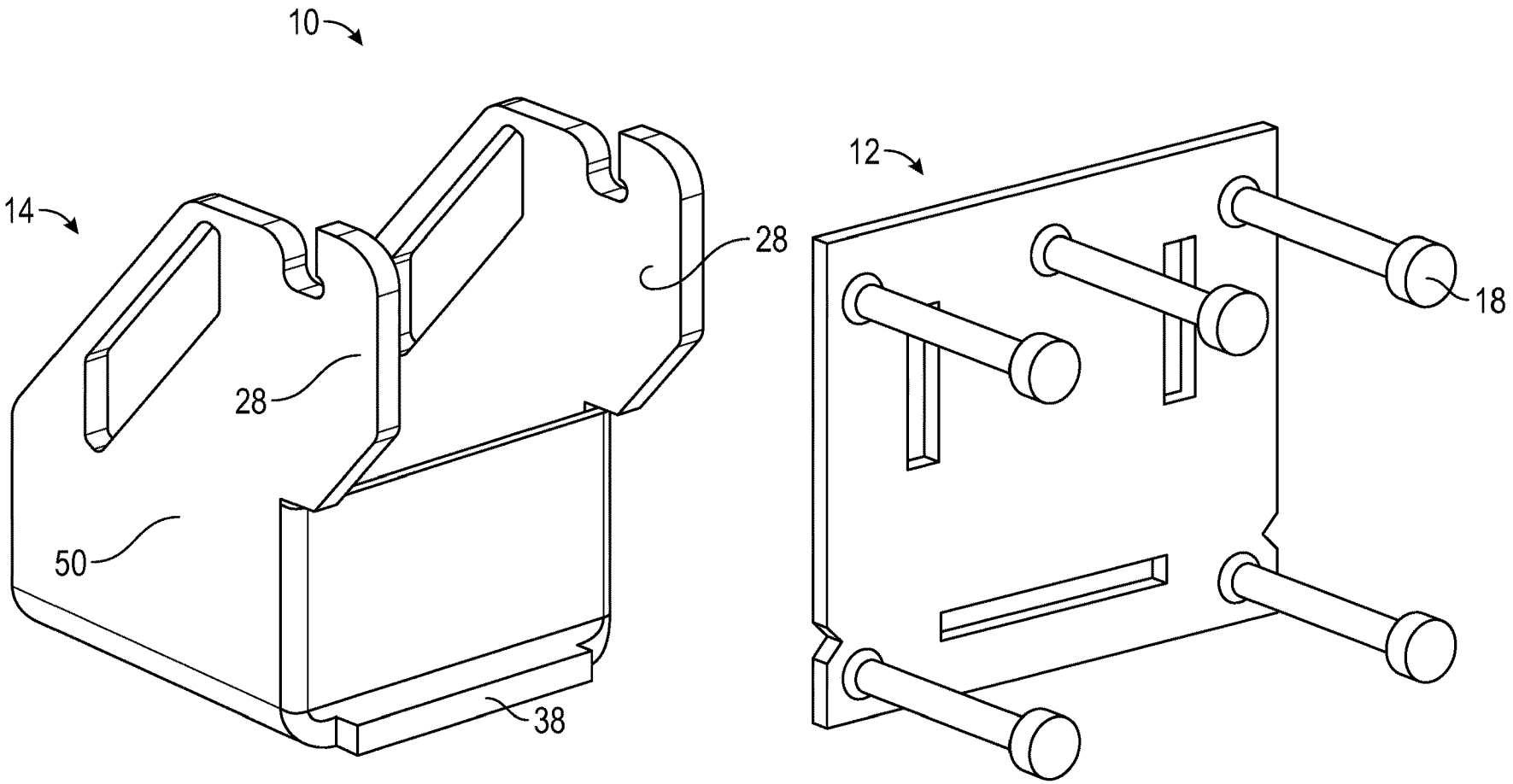
FIG. 5 is a rear perspective view of the connector system in accordance with the embodiment in FIG. 4.

Now referring to FIGS. 4 and 5, front and rear perspective views of another connector system 10 are provided, respectively. The receiving member 12 for this embodiment also has two first apertures 20 that have a longitudinal dimension oriented in a vertical direction. The receiving member 12 also has a single second aperture 22 that is oriented in a horizontal direction. The first protrusion 28 of the attachment member 14 has a retention surface 30 configured to contact a back surface of the receiving member 12, and the first protrusion 28 has a bearing surface 36 that is substantially perpendicular to the retention surface 30 and is configured to transfer at least a portion of the load on the attachment member 14 to the receiving member 12 and the precast concrete panel. A top surface or edge 32 is positioned adjacent the retention surface 30, and a distance between the top surface 32 and the bearing surface 36 is larger than the longitudinal dimension of the first apertures 20. A transition surface 48 extends between the top surface 32 and the bearing surface 36, and the transition surface 48 has a non-arcuate shape can promote the rotation of the first protrusion 28 from a first position to a second position as described elsewhere herein.

A horizontal member 24 is positioned on a lower end of the attachment member 14, and the horizontal member 24 receives a second structural member such as, for example, a beam or joist to connect the second structural member to the precast concrete panel in which the receiving member 12 is embedded. The lower position of the horizontal member 24 allows for the bottom surface of the second structural member to be closer to the bottom surface of the precast concrete panel, which can minimize the exposure of the connector system 10 below the second structural member and precast concrete panel and provide better positioning of the second structural member relative to an opening in, for instance, a parking garage.

Side plates 40 can extend from the horizontal member 24 and transition into the first protrusion 28. The side plates 40 partially define the volume that receives a second structural member, and the side plates 40 provide lateral stability for the second structural member such that the second structural member does not slide off of the horizontal member 40. This additional functionality can improve the integrity of the structure in which the connector system 10 is used, and can help maintain a connection between a precast concrete panel and a second structural member during a catastrophic event such as an earthquake. As depicted, the horizontal member 40, the side plates 50, and the first protrusions 28 are made from the same continuous material, but it will be appreciated that other configurations of these components are encompassed by the present invention.

Figure 6A:
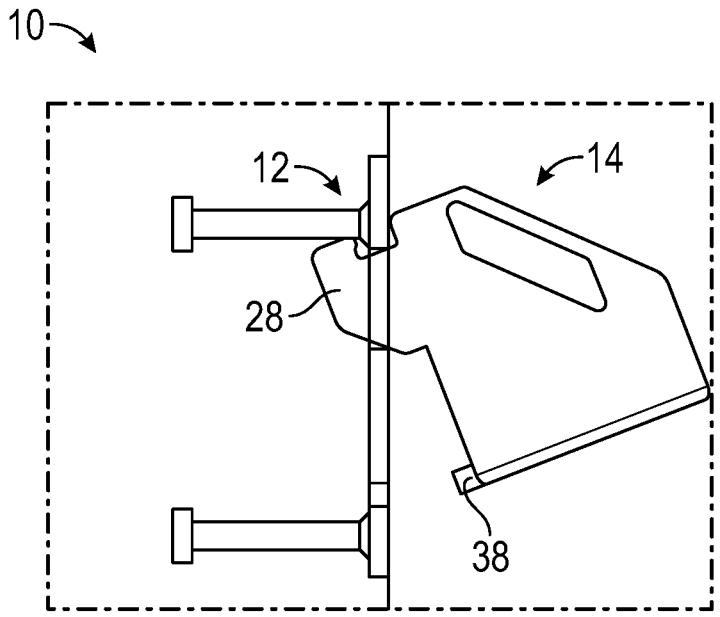
FIG. 6A is a partial cross-sectional, side elevation view of a connector system with an attachment member in a first position in accordance with the embodiment of FIG. 4.
Figure 6B:
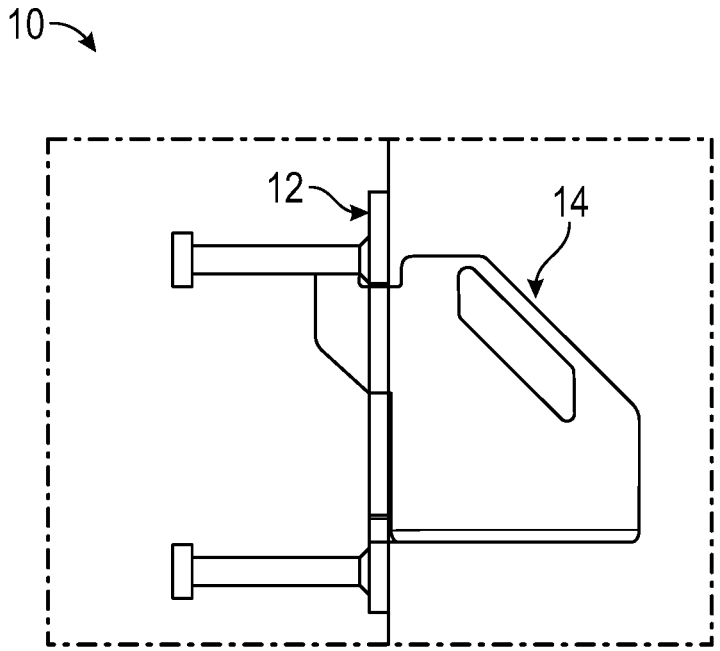
FIG. 6B is a partial cross-sectional, side elevation view of a connector system with an attachment member in a second position in accordance with the embodiment of FIG. 4.

Now referring to FIGS. 6A and 6B, cross-sectional side elevation views of the connector system 10 are provided where the attachment member 14 is in a first position and a second position, respectively. As described elsewhere herein, the attachment member 14 in the first position forms an acute angle with the receiving member 12 such that a first protrusion 28 can extend through a first aperture in the receiving member 12. Once the first protrusion 28 is in place, the attachment member 14 can be rotated into the second position where a second protrusion 38 extends into a second aperture. In the second position, the attachment member 14 is ready to receive a second structural member, and the connector system 10 transfers the load of the second structural member to the precast concrete panel in which the receiving member 12 is embedded.

Figure 7:
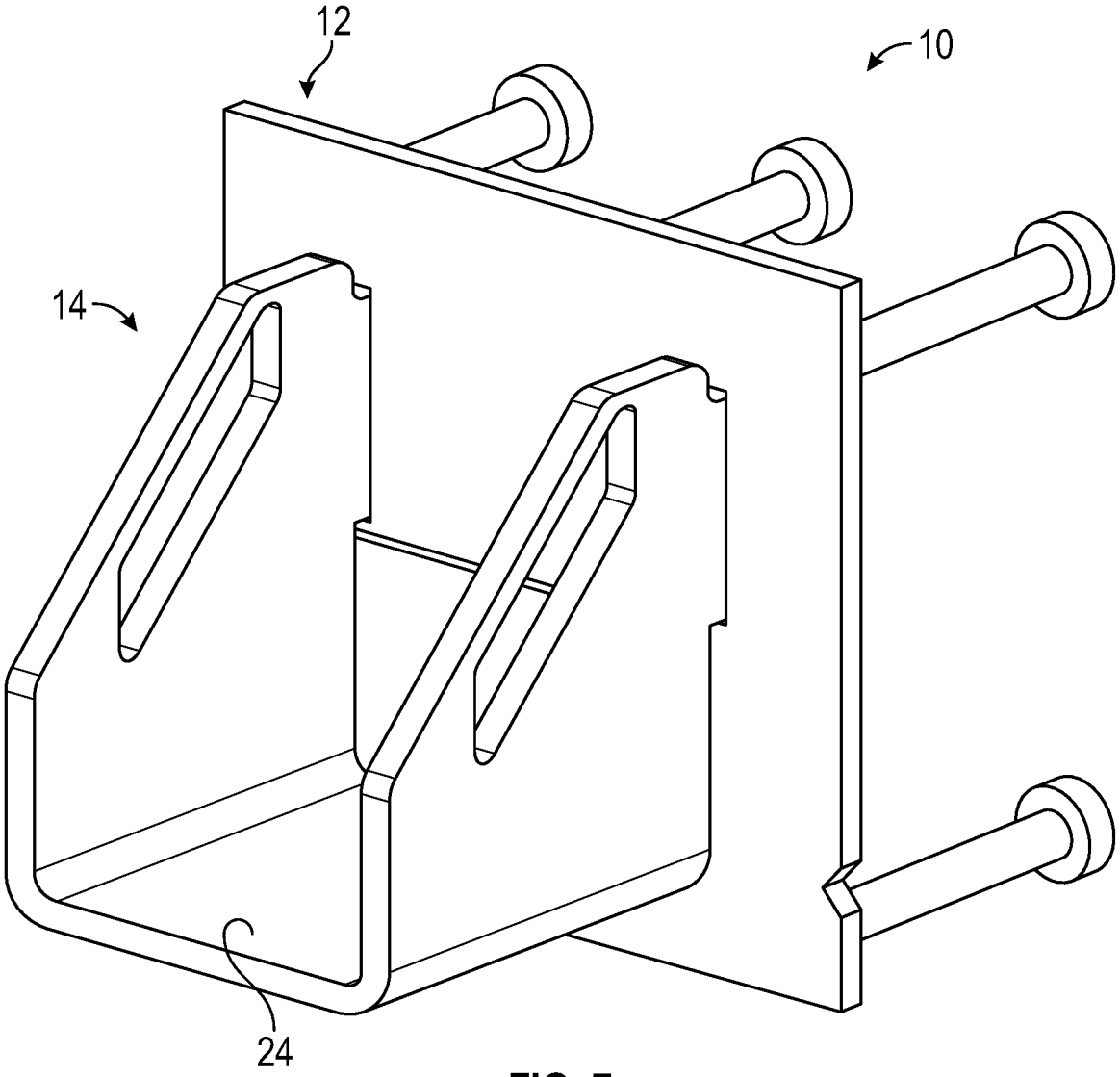
FIG. 7 is a front perspective view of a connector system in an assembled state in accordance with the embodiment in FIG. 4.

Now referring to FIG. 7, a perspective view of an assembled connector system 10 is provided. In this embodiment, the protrusions of the attachment member 14 are positioned in the apertures of the receiving member 12. The horizontal member 24 of the attachment member 14 is configured to receive a second structural member, and the connector system 10 transfers the load of the second structural member into the precast concrete panel in which the receiving member 12 is embedded.

Figure 8:
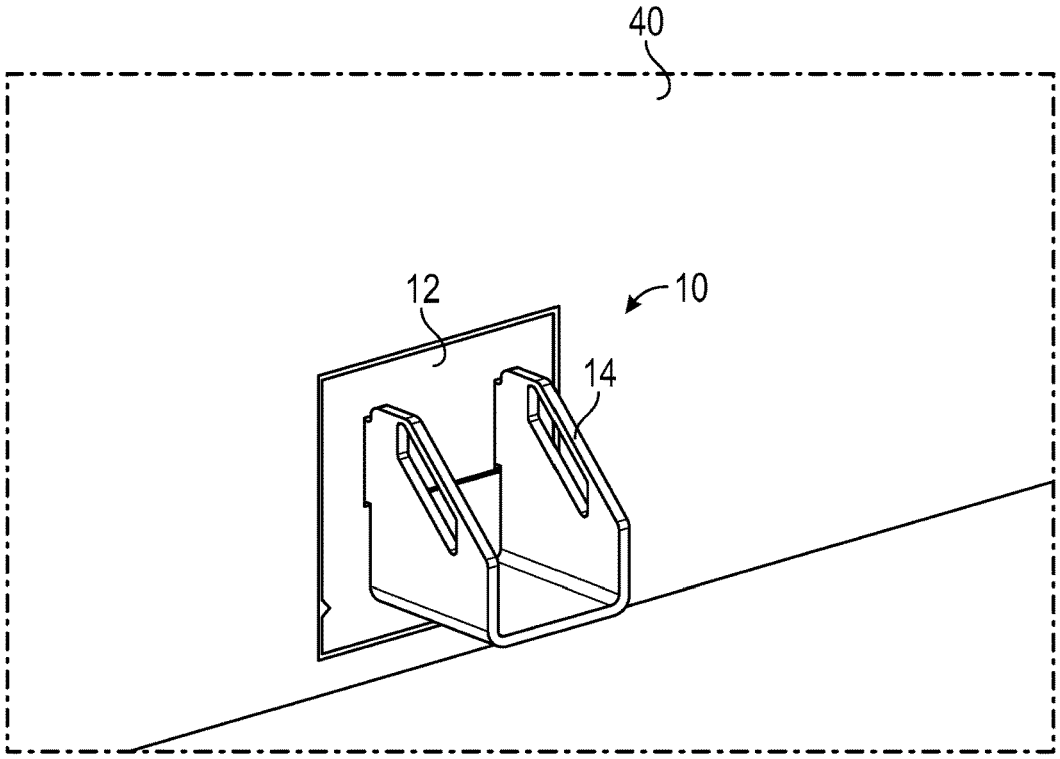
FIG. 8 is a perspective view of a connector system in an assembled state with the receiving member embedded in a precast concrete panel in accordance with one embodiment of the present invention.
Figure 9:
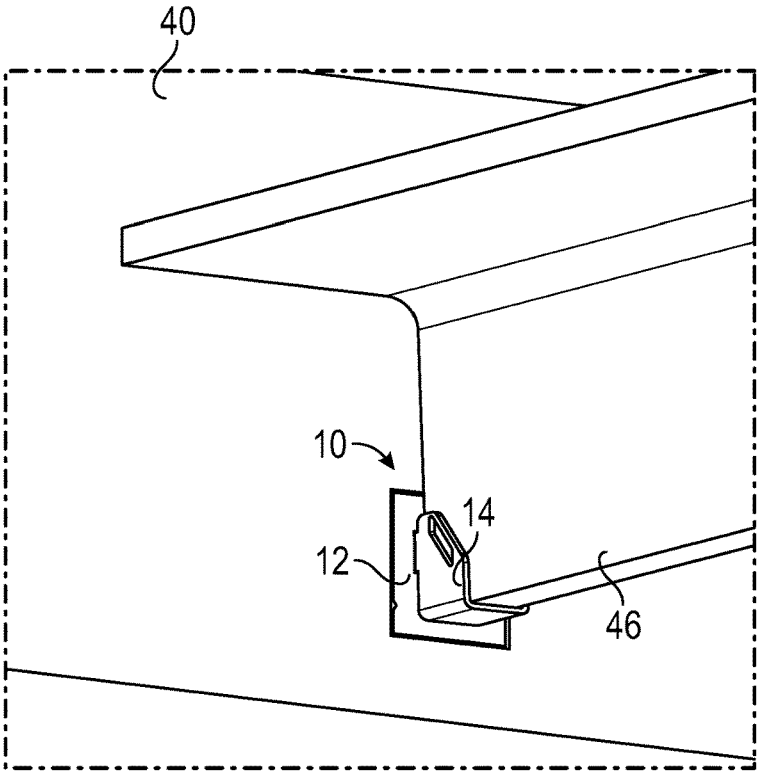
FIG. 9 is a perspective view of the connector system with a T-beam positioned on a horizontal member in accordance with the embodiment in FIG. 8.

Now referring to FIGS. 8 and 9, perspective views of a connector system 10 embedded in a precast concrete panel 40 with and without another structural member 46 are provided, respectively. In FIG. 8, the receiving member 12 is embedded into a precast concrete panel 40, the attachment member 14 is selectively interconnected to the receiving member 12. In FIG. 9, another structural member 46 is positioned on the attachment member 14, and the connector system 10 transfers the load of the second structural member 46 to the precast concrete panel 40. The construction of the connector system 10, in particular the low positioning of the horizontal member of the attachment member 14, allows the second structural member 46 to rest in a lower and more stable position.

It will also be appreciated that a shim or plurality of shims can be positioned between the attachment member and the receiving member to modify the relative orientation of the two members. For instance, in some embodiments, the receiving member may be embedded in a precast concrete panel that is not oriented vertically with respect to a ground surface. Therefore, at least one shim can be positioned between the members such that a planar surface of the attachment member is oriented substantially parallel to the ground surface.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A structural connector for a precast concrete panel, comprising:

a receiving member having a body with at least one anchor extending from a back surface of said body, said receiving member having a first aperture and a second aperture, and wherein said first aperture has a vertical dimension;

an attachment member having a first protrusion and a second protrusion, wherein said first protrusion has a retention surface, a top surface adjacent to said retention surface, a bearing surface oriented substantially perpendicular to said retention surface, and an arcuate transition surface extending from said top surface to said bearing surface, wherein a distance between said top surface and said bearing surface is larger than said vertical dimension of said first aperture;

wherein, in a first position, said attachment member is oriented with respect to said receiving member such that said first aperture receives said first protrusion;

wherein, in a second position, said attachment member is oriented with respect to said receiving member such that said retention surface contacts said back surface of said body and said second recess receives said second protrusion; and wherein said receiving member is embedded in a precast concrete panel that has an arcuate void that corresponds to said arcuate transition surface, and wherein said arcuate transition surface is rotated within said arcuate void to reorient said attachment member from said first position to said second position.

2. The structural connector of claim 1, wherein in said first position, said bearing surface of said first protrusion is positioned outside of said first aperture.

3. The structural connector of claim 1, wherein in said second position, said bearing surface of said first protrusion is configured to contact an inner surface of said first aperture.

4. The structural connector of claim 1, further comprising:

a horizontal member of said attachment member that is oriented substantially parallel with said bearing surface, wherein said horizontal member is configured to receive a second structural member.

5. The structural connector of claim 1, wherein said vertical dimension of said first aperture is oriented between an upper end and a lower end of said receiving member.

6. The structural connector of claim 1, further comprising:

a bearing surface of said second protrusion that is substantially parallel with said bearing surface of said first protrusion, wherein, in said first position, said bearing surface of said second protrusion is positioned outside of said second aperture, and wherein, in said second position, said bearing surface of said second protrusion contacts an inner surface of said second aperture.

7. The structural connector of claim 1, wherein said second protrusion is aligned with said first protrusion in a horizontal direction of said attachment member.

8. The structural connector of claim 1, wherein said arcuate transition surface extends along a constant radius of curvature.

9. The structural connector of claim 1, wherein said first protrusion and said second protrusion extend from a common end of said attachment member, and wherein said first protrusion extends from said common end by a first distance, and said second protrusion extends from said common end by a second distance that is less than said first distance.

10. The structural connector of claim 9, wherein said second distance is substantially equal to a thickness of said receiving member.

11. The structural connector of claim 1, wherein a vertical dimension of said second aperture is smaller than said vertical dimension of said first aperture.

12. The structural connector of claim 1, wherein a distance between a lower end of said retention surface and said bearing surface is substantially equal to said vertical dimension of said first aperture.

13. The structural connector of claim 12, wherein a distance between a bearing surface of said second protrusion and an upper surface of said second protrusion is substantially equal to a vertical dimension of said second aperture.

* * * * *